US006788001B2

(12) United States Patent
Lechner

(10) Patent No.: US 6,788,001 B2
(45) Date of Patent: Sep. 7, 2004

(54) LIGHTING SYSTEM WITH CARING PREHEATING OF GAS DISCHARGE LAMPS

(75) Inventor: Alfons Lechner, Hohenwart (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/983,715

(22) Filed: Oct. 25, 2001

(65) Prior Publication Data

US 2002/0050797 A1 May 2, 2002

(30) Foreign Application Priority Data

Oct. 30, 2000 (DE) ..... 100 53 803

(51) Int. Cl.[7] ..... H05B 39/00
(52) U.S. Cl. ..... 315/94; 315/291; 315/307
(58) Field of Search ..... 315/86, 94, 209 R, 315/219, 224, 229, 291, 307, DIG. 7, 98, 105

(56) References Cited

U.S. PATENT DOCUMENTS 3,619,716 A * 11/1971 Spira et al. ..... 315/244
3,869,639 A * 3/1975 Herzog ..... 315/86
4,238,708 A * 12/1980 Kaneda ..... 315/289
4,350,935 A * 9/1982 Spira et al. ..... 315/291
5,404,082 A * 4/1995 Hernandez et al. ..... 315/219
5,424,614 A * 6/1995 Maheshwari ..... 315/209 R

* cited by examiner

*Primary Examiner*—James Vannucci
*Assistant Examiner*—Jimmy T. Vu
(74) *Attorney, Agent, or Firm*—Carlo S. Bessone

(57) ABSTRACT

In a lighting system which includes an electronic operating device and a gas discharge lamp with filaments, one filament terminal is respectively connected to an impedance network. The impedance network has an impedance function with a zero point at the frequency f1. For preheating purposes, the electronic operating device outputs a voltage whose frequency is close to the frequency f1. As a result, the voltage across the lamp is below the non-starting voltage during preheating.

4 Claims, 1 Drawing Sheet

LIGHTING SYSTEM WITH CARING PREHEATING OF GAS DISCHARGE LAMPS

TECHNICAL FIELD

The invention relates to a lighting system which comprises an electronic operating device and at least one gas discharge lamp with filaments. In particular, the preheating operation of the gas discharge lamps is intended to be improved.

PRIOR ART

In an electronic operating device for gas discharge lamps, an AC voltage generator G which operates at a frequency which is substantially higher than the line frequency feeds energy into a load circuit. This state of affairs is illustrated in a block diagram in FIG. 1. The AC voltage generator G is connected to a load circuit comprising a lamp inductor L1, a resonance capacitor C1 and a gas discharge lamp Lp. The gas discharge lamp will be called a lamp for short in what follows. As illustrated in FIG. 1, the lamp inductor L1 and the resonance capacitor C1 mostly form a series resonant circuit which is connected to the AC voltage generator G. The lamp Lp is connected in parallel with the resonance capacitor C1. Not only is this configuration suitable for operating the lamp Lp, but it also permits the lamp to be started. Before the starting of the lamp, the load circuit constitutes a series resonant circuit of high quality. If this resonant circuit is excited with its resonant frequency, there is produced across the lamp Lp a high voltage which leads to the starting of the lamp. In order to lengthen the lifetime of the lamp, the filaments W1 and W2 of the lamp Lp must be preheated before the starting. The circuit illustrated in FIG. 1 has proved itself for the purpose of implementing preheating. The resonance capacitor C1 is not connected directly to the lamp inductor L1 and the AC voltage generator G. Rather, connection to the lamp inductor L1 is performed via the filament W1, and connection to the AC voltage generator G is performed by the filament W2. For preheating purposes, the AC voltage generator G outputs a voltage whose frequency is substantially above the resonant frequency of the series resonant circuit comprising the lamp inductor L1 and the resonance capacitor C1. The filaments W1, W2 therefore already conduct current before the starting, and are preheated. This preheating operation leads, however, to a dilemma: firstly, the preheating current must be strong enough to heat up the filaments to the required temperature in a time which is to be in the range of a second. For this purpose, the frequency of the voltage which the AC voltage generator G outputs during preheating may not be selected to be too high. Secondly, during the preheating the voltage across the lamp Lp may not be too high, since glow discharges harmful to the filaments otherwise occur. For this purpose, the frequency of the voltage which is output by the AC generator G during the preheating may not be selected to be too low. The decisive factor for this is the non-starting voltage specified by the lamp manufacturer. It may not be exceeded during preheating. For many lamps, there is no frequency for the voltage output by the AC voltage generator G during preheating for which both conditions named above are fulfilled. All possible frequencies are either too close to the resonant frequency of the series resonant circuit, comprising the lamp inductor L1 and resonance capacitor C1, and therefore produce too high a voltage across the lamp Lp, or they are too far removed from the resonant frequency and therefore produce an excessively low preheating current.

SUMMARY OF THE INVENTION

It is an object of the present invention to provide a lighting system in which the lamps can be preheated in a short time without the non-starting voltage specified for the lamps being exceeded.

According to the invention, the above-described resonance capacitor C1 is replaced by an impedance network which has the following properties: the impedance function of the impedance network has a zero point at the frequency f1. In accordance with the above statements relating to the prior art, the impedance network is connected in series to the lamp inductor L1 via the filaments W1, W2. The series circuit of the impedance network with the lamp inductor L1 has an impedance function with a zero point at the frequency f2. For preheating purposes, the AC voltage generator G now outputs a voltage whose essential spectral component is at a frequency which is near the frequency f1 for the zero point of the impedance function of the impedance network. "Near the frequency f1" describes in this context a frequency band from 0.8*f1 to 1.2*f1. The voltage across the lamp is thereby low (below the non-starting voltage) and at the same time it is possible to implement a sufficiently high current through the filaments W1, W2 which permits a preheating time of less than a second. For starting purposes, the AC voltage generator G outputs a voltage whose essential spectral component is at a frequency which is near the frequency f2 for the zero point of the impedance function of the series circuit comprising the lamp inductor L1 and the impedance network.

A simple configuration of the impedance network consists of the series circuit of a capacitor and an inductor. If the capacitor has the capacitance C and the inductor the inductance L, the zero point of the impedance function is at a frequency $f_1=1/2\pi\sqrt{LC}$.

A preheating circuit according to the invention can also be used for lighting systems with a plurality of lamps. All combinations of parallel and series connection are possible in this case. In the case of parallel connection, a plurality of lamp circuits which contain an impedance network according to the invention, a lamp inductor and a lamp are connected in parallel. In the case of series connection, only the lamps are connected in series. It then suffices to connect the impedance network according to the invention with in each case one filament terminal of the first and last lamp of the series circuit of lamps.

DESCRIPTION OF THE PREFERRED EMBODIMENT

Figure 1:
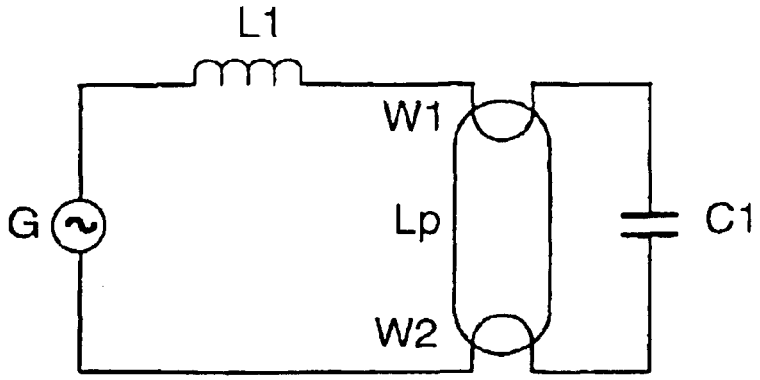
FIG. 1 shows a block diagram relating to the prior art.

FIG. 1 has already been explained in the statements relating to the prior art.

Figure 2:
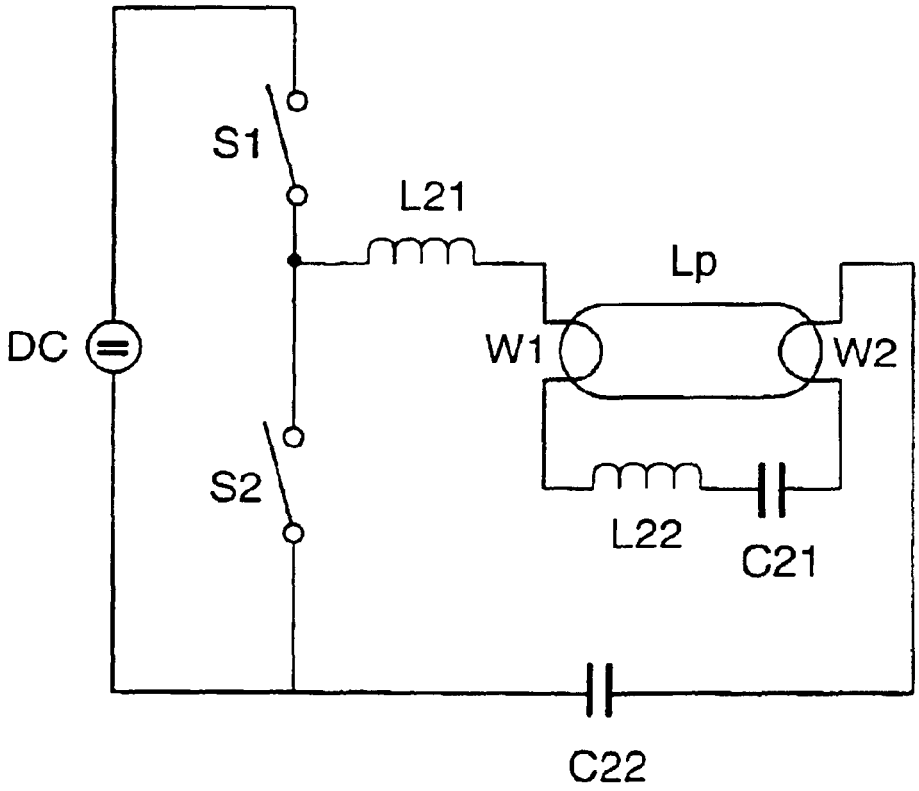
FIG. 2 shows a diagram of a preferred exemplary embodiment of the invention.

The AC voltage generator G is designed in FIG. 2 as a half-bridge inverter. This circuit has spread for operating devices for lamps because of its low costs and its reliability. It essentially comprises a series circuit of two switches S1 and S2. It is fed by a DC voltage source DC. If the half-bridge is to be operated on an AC network, suitable circuits which simulate a DC voltage source are to be inserted between the mains connection and the half-bridge. In practice, all semiconductor switches such as, for example, bipolar transistor, FET and IGBT can be used for the switches S1 and S2. Switches S1 and S2 are switched on and off alternately. This renders an AC voltage available at the connection point of the switches S1 and S2. The series circuit comprising a lamp inductor L21, a lamp Lp and a coupling capacitor C22 is connected to this connection point. The other end of this series circuit is connected to the positive or negative pole of the DC voltage source DC. Since the lamp includes the filaments W1 and W2, it has four terminals; two for each filament. One terminal of a filament is used in each case for the series circuit with the lamp inductor L21 and coupling capacitor C22. According to the invention, an impedance network comprising the series circuit of a capacitor C21 and an inductor L22 is connected between the respective other terminals. The capacitor C22 serves to isolate the direct component of the AC voltage supplied by the half-bridge. For preheating purposes, the half-bridge is now clocked such that it outputs a square-wave AC voltage with a frequency f1 which is close to the resonant frequency of the series resonant circuit comprising the capacitor C21 and the inductor L22. The following values are suitable for a lighting system with a 20W fluorescent lamp:

Lamp inductor L21: 1.7 mH
Capacitor C21: 2.7 nF
Inductor L22: 1.8 mH
Coupling capacitor C22: 100 nF
Preheating frequency f1: 65 kHz

What is claimed is:

1. A lighting system which includes an electronic operating device and a gas discharge lamp with filaments, characterized in that one filament terminal of each filament is connected to an impedance network whose impedance function has a zero point at a frequency which is close to a frequency which the electronic operating device generates before the starting of the gas discharge lamp.

2. The lighting system as claimed in claim 1, characterized in that the impedance network includes a series circuit of a capacitor (C21) and an inductor (L22).

3. The lighting system as claimed in claim 1, characterized in that the electronic operating device includes a half-bridge inverter.

4. A lighting system which includes an electronic operating device and a plurality of series-connected gas discharge lamps with filaments, characterized in that in each case one filament terminal of the first and the last gas discharge lamp of the series circuit is connected to an impedance network whose impedance function has a zero point at a frequency which is close to a frequency which the electronic operating device generates before the starting of the gas discharge lamp.

* * * * *